US008567139B2

(12) United States Patent
Stein

(10) Patent No.: US 8,567,139 B2
(45) Date of Patent: Oct. 29, 2013

(54) "LOG" BUILDINGS WITH STRENGTHENING AND INSULATING SADDLES

(76) Inventor: Alejandro Stein, Crans-Pres-Celigny (CH)

( * ) Notice: Subject to any disclaimer, the term of this patent is extended or adjusted under 35 U.S.C. 154(b) by 32 days.

(21) Appl. No.: 12/287,832

(22) Filed: Oct. 14, 2008

(65) Prior Publication Data

US 2010/0088979 A1 Apr. 15, 2010

(51) Int. Cl.
*E04B 2/00* (2006.01)

(52) U.S. Cl.
USPC ..... 52/233; 52/284; 52/587.1; 52/745.1; 52/404.4

(58) Field of Classification Search
USPC ..... 52/233, 284, 270, 582.1, 582.2, 586.1, 52/586.2, 587.1, 588.1, 741.13, 745.1, 52/747.1, 404.5, 404.4; 446/104; 138/106, 138/112; 428/122, 36.1–36.5, 77–78; 442/1, 2, 30, 42, 20, 22, 43, 50, 55, 58
See application file for complete search history.

(56) References Cited

U.S. PATENT DOCUMENTS

| | | | | | |
|---|---|---|---|---|---|
| 1,611,907 | A | * | 12/1926 | Hall | 428/172 |
| 1,950,014 | A | | 3/1934 | Wencz | |
| 2,634,601 | A | * | 4/1953 | Cloyd | 52/213 |
| 2,946,150 | A | * | 7/1960 | Houk | 446/106 |
| 3,969,859 | A | * | 7/1976 | Hisey | 52/233 |
| 4,126,977 | A | * | 11/1978 | Chisum | 52/233 |
| 4,279,108 | A | * | 7/1981 | Collister, Jr. | 52/233 |
| 4,288,954 | A | * | 9/1981 | O'Donnell | 52/233 |
| 4,356,676 | A | * | 11/1982 | Hauptman | 52/396.04 |
| 4,433,519 | A | * | 2/1984 | Jenkins | 52/233 |
| 4,619,089 | A | | 10/1986 | Stein | |
| 4,649,683 | A | * | 3/1987 | Dolata | 52/233 |
| 4,778,700 | A | * | 10/1988 | Pereira | 428/41.7 |
| 4,951,435 | A | * | 8/1990 | Beckedorf | 52/233 |
| 5,253,458 | A | | 10/1993 | Christian | |
| 5,282,343 | A | | 2/1994 | Stein | |
| 5,423,153 | A | | 6/1995 | Woolems et al. | |
| 5,782,046 | A | * | 7/1998 | Karlsson | 52/233 |
| 6,341,626 | B1 | * | 1/2002 | Davenport et al. | 138/110 |
| 2002/0092256 | A1 | * | 7/2002 | Hendrickson et al. | 52/519 |
| 2003/0208976 | A1 | * | 11/2003 | Carroll, Sr. | 52/404.5 |
| 2007/0175129 | A1 | * | 8/2007 | Nordli | 52/233 |

FOREIGN PATENT DOCUMENTS

EP 0 473 012 A1 3/1992

* cited by examiner

*Primary Examiner* — Brian Glessner
*Assistant Examiner* — Jessie Fonseca
(74) *Attorney, Agent, or Firm* — Donald S. Dowden

(57) ABSTRACT

A building wall or roof is formed of tubular structural members arranged in parallel, planar, spaced-apart relation. Saddle-shaped structural members having strengthening portions are respectively mounted on the tubular members with a clearance space, and thermal and/or acoustical insulation is interposed in the clearance space between the strengthening portions and the tubular members. As compared to conventional tubular log structures, the resulting wall or roof is resistant to horizontal forces generated by the wind or earthquakes and is faster and easier to construct and, furthermore, considerably better performing in terms of thermal and acoustic insulation without having to increase its thickness on an otherwise proportionate basis.

16 Claims, 8 Drawing Sheets

54
50
52
30
28
24
56
26
14
16

72

"LOG" BUILDINGS WITH STRENGTHENING AND INSULATING SADDLES

BACKGROUND OF THE INVENTION

1. Field of the Invention

This invention relates to buildings made of hollow "logs," and more particularly to a novel and highly effective combination of elements that greatly improves the strength, thermal and/or acoustical insulation, and other properties of such buildings while reducing their cost.

2. Description of the Prior Art

Hollow logs enclose an air chamber and therefore have a thermal insulation capacity. But if hollow logs are assembled to form a wall or roof and are made of certain materials, like steel, such capacity is limited, because there is no thermal convection barrier between the logs and because logs made of those materials readily conduct heat from the warmer side to the cooler side of the wall or roof. In view of the high price of oil and other fuels, these aspects of the system are worth reconsidering. As indicated below, the applicant has addressed this handicap by closing the interstices between the logs in a novel way.

Log buildings have a long history, as indicated in applicant's co-pending U.S. patent application Ser. Nos. 12/157,051 and 12/218,913, filed respectively on Jun. 6 and Jul. 18, 2008. Those applications and the applicant's prior U.S. Pat. Nos. 4,619,089 and 5,282,343 are incorporated herein by reference. Traditional log buildings made of wood have drawbacks, including the sheer weight and bulk of the logs and the consequent expense and difficulty of shipping and handling them; their lack of uniformity, even when trimmed to size; the inevitable waste, and, in many locales, the scarcity of wood. But because log structures have a certain aesthetic appeal, wood logs are still used to some extent to construct houses, sheds and other low-rise buildings including apartments, schools, lodges and commercial buildings. Usually, however, wooden structures today are not made of logs but are framed with sills, joists, studs, rafters, and ridgepoles and finished with interior and exterior sheathing.

As applicant's co-pending applications identified above explain, the construction of log buildings has undergone considerable evolution. Whereas it traditionally employed solid wood logs, it now may employ hollow metallic "logs" that have undeniable merits, including savings in the cost and volume of materials, shipping and labor, lack of dependence on skilled labor, speed of construction, adaptability to use in remote locations, and resistance to damage by fire and termites. Indeed, experts predict that hollow metal structures called "metalogs" by analogy to conventional wood logs could become a preferred way of construction in much of the world for low-rise buildings.

The '089 and '343 patents identified above and corresponding patents in other countries disclose the best prior examples of metalog construction. Buildings following their teachings have been erected in many parts of the world and are finding wide and growing acceptance. They are suitable for all markets in view of their properties noted above. Government authorities and private builders in various countries have endorsed them because of their affordability and the rapidity with which they can be erected, etc.

Air is a poor conductor of heat and in the absence of convection a good insulator. One reason for the growing popularity of hollow-metal-log construction is that metalogs, by virtue of the air they enclose, have inherent insulating properties, even if made of a material such as aluminum or steel that readily conducts heat. In some climates, however, their inherent insulating properties may be insufficient, since the metal, even though thin and thus having relatively modest mass, conducts heat from the warmer side of a wall formed by the logs to the cooler side. (We sometimes also say colloquially that "cold"—the absence of heat—is conducted from the cooler side of the wall to the warmer side.) Even if the logs are made of plastic or another material having good insulating properties, conventional hollow log structures may not be suited to extreme climates.

In cold climates, the conduction of heat through the material of which the logs of an exterior wall are formed and the radiation of the heat into the surroundings cools the material and therefore the air within the building near the wall. This increases the density of that air and causes an uncomfortable downdraft of cold air near the wall, and an uncomfortable flow of cold air near the floor and towards the center of the room of which the wall forms a boundary. Below a certain temperature that depends on the relative humidity of the air within the room, condensation forms on the wall, giving the room a clammy feeling. And the constant escape of heat to the environment increases the expense of maintaining a set temperature within the building. The high and rising price of heating oil and other fuels intensifies the need to find a remedy.

In hot climates, the flow of heat is often in the other direction. Solar radiation heats the outer side of the logs, and the material of which the logs are made conducts the heat to the interior of the building, raising the temperature and causing discomfort to the people there. Even after sunset, it is likely in the absence of air-conditioning to be noticeably warmer inside than outside the building. And the operating cost of air-conditioning is proportional to the ease with which heat flows from the outside to the inside of the building.

Thermal insulation is of course known as a means of helping to control temperatures in structures of all types in both cold and hot climates. An installation of thermal insulation in a conventional wood-frame structure involves blowing insulating material into the spaces between studs, joists or rafters, and/or positioning batts or mats of insulation by hand in those spaces. As conventionally practiced, both methods have a number of drawbacks.

In either case, the thickness of the insulation is often determined by the width of the studs, joists or rafters, rather than by the required R-value (apparent thermal conductivity) of the insulation.

Batt and mat insulation has the additional drawback that it is likely to leave small gaps between the batts or mats and adjoining support structures, thereby providing passages for the escape of heat. Since the adjoining support structures such as two-by-four studs are normally at intervals of 16 inches in the US and at similar intervals in other countries, there may be many such leakage passages in the span of a typical wall or roof.

Blown insulation poses a significant health risk to the workers who do the installation. Inevitably, despite wearing (usually nowadays, though not formerly) protective masks, they inhale small airborne fibers of asbestos, rock wool, fiberglass or other insulating material, which can cause mesothelioma, chronic obstructive pulmonary disease and other serious medical conditions.

Neither blown insulation nor manually placed batts or mats have been used in hollow-metal-log construction. Insulation blown into hollow metal logs would have indeed a benefit, but the net benefit would be modest, because blown insulation displaces air—itself a good insulator—and does little to retard heat transfer through spaces between logs by convection or through the metal by conduction. And neither blown insulation nor batts/mats can be deployed in separate channels exterior to hollow metal logs without the provision of elaborate auxiliary structure for their support or, at least, their protection from weather, etc.

Applicant's '343 patent identified above discloses in FIGS. 8*a-d* and associated text the best methods known heretofore of applying thermal insulation to metal logs. They involve winding a mat through gaps between logs, covering the logs with wide mats overlapping like shingles on one or both sides of the logs, or wrapping mats around the logs to form sleeves. None of these methods provides structural support for a wall or roof or provides weather resistance, and all require additional interior and exterior sheathing.

In conventional metal log construction of, say, a rectangular wall, hollow metalogs, each extending usually horizontally, are arranged in adjacent, parallel, superposed relation. The logs are supported at their ends, typically though not necessarily in slightly spaced-apart relation, by end connectors each having a connecting portion inserted into a log and a stackable portion. The stackable portions are stacked one above another. Alternatively, the ends of the logs are stacked in vertical retaining grooves formed in stanchions, as shown in FIGS. 12 and 13 of the applicant's '089 patent mentioned above.

In conventional practice, in order to prevent infiltration of air and water, it is necessary to install at least exterior sheathing, and builders usually wish to install interior sheathing as well.

OBJECTS AND SUMMARY OF THE INVENTION

An object of the invention is to improve further the construction methods and resulting buildings disclosed in the patents mentioned above and in other prior art. In particular, an object of the invention is to simplify and speed up the construction of metalog buildings while lowering their cost and considerably improving their thermal insulation without increasing the thickness of exterior walls and roofs on an otherwise proportional basis.

The invention attains these and other objects through a novel combination of elements, including a saddle-shaped structural member having a strengthening portion formed with a concave surface and thermal and/or acoustical insulation. The insulation is adhered to a section of the concave surface and fits at least partly around a tubular structural member (e.g., a metalog) adapted to form part of a wall or roof of a building superstructure.

From another standpoint, a building wall or roof according to the invention comprises a tubular structural member and a saddle-shaped structural member. The latter has a strengthening portion formed with a concave surface fitting partly around the tubular member and leaving a clearance space. Thermal insulation is interposed in the clearance space between the strengthening portion and the tubular member.

A plurality of such tubular structural members are arranged in parallel, planar, spaced-apart relation, and a plurality of saddle-shaped members respectively having strengthening portions formed with concave surfaces fit partly around the tubular members and leave clearance spaces. Thermal insulation is interposed in the clearance spaces between the strengthening portions and the tubular members.

The tubular members are made of a metal, cementitious or synthetic material and the strengthening portions are made of a material selected from the group consisting of a metal, a synthetic material, a cementitious material, a natural fiber, and combinations of two or more thereof.

The saddle-shaped members can be formed of a solid waterproof material but preferably comprise meshes or are otherwise formed with openings affording access to the insulation and permitting manipulation thereof from a position exterior to the wall or roof. The insulation can thus be curved around the logs or otherwise contoured even after the logs with their insulated saddles are in place in a wall or roof.

If the saddles are formed of a solid material making it impossible to manipulate the insulation from a position exterior to the wall or roof after the saddles are in place in a wall or roof, the insulation can be wrapped around the logs before the logs are added to the wall or roof.

Where sections of a wall or roof made in accordance with the invention meet at a corner, the angle they form is sometimes but not always a right angle. In any case, insulating corner pieces are provided in accordance with the invention to retard the passage of heat and/or sound through the corners.

In cross section, the saddle-shaped members can be U-shaped, with legs of substantially equal length, or J-shaped, with legs of unequal length.

The invention extends also to a method comprising the steps of selecting a tubular structural member as an element of a wall or roof of a building superstructure and selecting a saddle-shaped structural member formed with a strengthening portion. The latter has a concave surface sized to fit partly around the tubular member leaving a clearance space. Thermal and/or acoustic insulation is selected of a thickness proportional to the clearance space. An assembly is then formed wherein the insulation is sandwiched between the tubular member and the strengthening portion.

In this method, one can form a preliminary assembly comprising the insulation and the strengthening portion and then mount the preliminary assembly on the tubular member. The step of forming the preliminary assembly can be performed at an actual building construction location or at a workshop removed from an actual building construction location and transported or carried to the construction location.

It is also within the scope of the invention to form an alternative preliminary assembly comprising the insulation and the tubular member and then mount the strengthening portion on the alternative preliminary assembly. As before, the step of forming the alternative preliminary assembly can be performed at an actual building construction location or at a workshop removed from an actual building construction location and transported or carried to the construction location.

In accordance with the invention, the tubular member, strengthening portion and insulation extend in an axial direction and, in that direction, the tubular member is longer than the strengthening portion and the strengthening portion is longer than the insulation. One end of the insulation is aligned with an end of the strengthening portion to form a first strengthening and insulating unit having a flush end wherein the strengthening portion and insulation are in flush relation. Opposite the flush end is an overhang end wherein the strengthening portion overhangs the insulation. Two such strengthening and insulating units are mounted on a log with the flush end of one unit inserted into the overhang end of the other unit for structural rigidity.

As indicated above, the insulating saddles impede the flow of heat and/or sound between the interior and exterior of a building of which the wall or roof forms a part. In addition, even though the strengthening portions need not be rigid and preferably are flexible, they have considerable tensile strength when screwed or riveted to the metalogs or when receiving stucco on their overlapping surfaces and obviate the use of the crisscross bracing (X-bracing) required to stabilize the walls of a conventional metal log building. If formed of a solid waterproof material, the strengthening portions moreover can serve as exterior and/or interior sheathing, obviating the provision of additional sheathing. If formed of a mesh, a stucco finish can be added using the mesh as support.

Instead of sheathing opposite sides of a wall with separate panels, as in the prior art, the invention provides components shaped in a way that insulates the logs on all their sides, including the spaces between logs. If additional external sheathing is employed, it need not have exceptional insulating properties.

When installed in the usual manner in horizontal courses, the horizontal dimensions of the saddles can be adjusted to fit at one end of a wall (as at a corner of a building superstructure) or section thereof (as at a doorjamb), and if need be at both ends. Fractional insulating batts can be inserted at corners and doorjambs if required to insulate the adjacent overhangs.

The shape of the outer surfaces of the saddles exposed on the outside or inside of a wall or roof, being decoupled from the shape of the logs, is typically substantially planar but can take any form the developer or builder wishes to give it.

The structure described above is repeated as necessary with the saddles mounted on logs to form a complete wall or roof, either of which can be covered with a rain-shedding material. Ultimately, an entire edifice is constructed in accordance with the invention, with suitable provision for doors, windows, floors, chimneys, vents, electrical service, supply and waste plumbing, etc.

BRIEF DESCRIPTION OF THE DRAWINGS

A better understanding of the objects, features and advantages of the invention can be gained from the following detailed description of the preferred embodiments thereof, in conjunction with the appended figures of the drawings, wherein.

DETAILED DESCRIPTION OF PREFERRED EMBODIMENTS OF THE INVENTION

Figure 1:
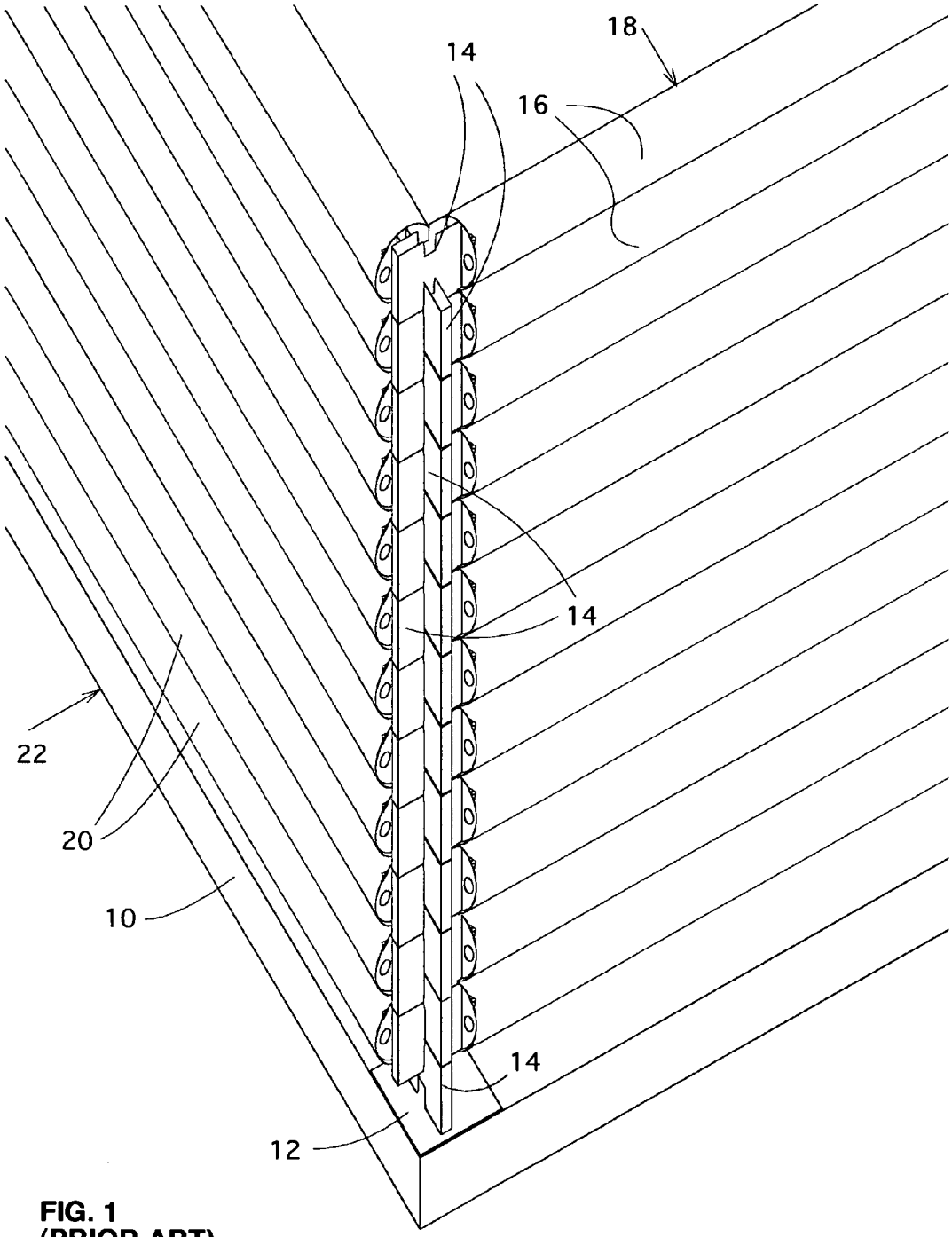
FIG. 1 (PRIOR ART)
FIG. 1 is a perspective view of a corner of a conventional building superstructure made of hollow metal logs, showing end connectors that fit within the logs, the end connectors being stacked one on top of another and the logs being supported by the end connectors, possibly though not necessarily in spaced-apart relation, to form two walls that intersect at a right angle.

The prior art shown in FIG. 1 and described in applicant's co-pending applications identified above includes a slab 10 that supports an anchor plate 12 upon which are stacked end connectors 14. The end connectors 14 are alternately inserted into hollow metal logs 16 forming part of a first wall 18 and hollow metal logs 20 forming part of a second wall 22. The slab 10 normally rests upon the ground and can be made of poured concrete or another suitable foundation material. The anchor plate 12 can be made of steel and is embedded in or otherwise firmly attached to the slab 10. The lowermost end connector 14 is secured to the anchor plate 12. Higher end connectors are stacked alternately at right angles to one another and inserted alternately into respective ends of logs 16 and 20.

Figure 12:
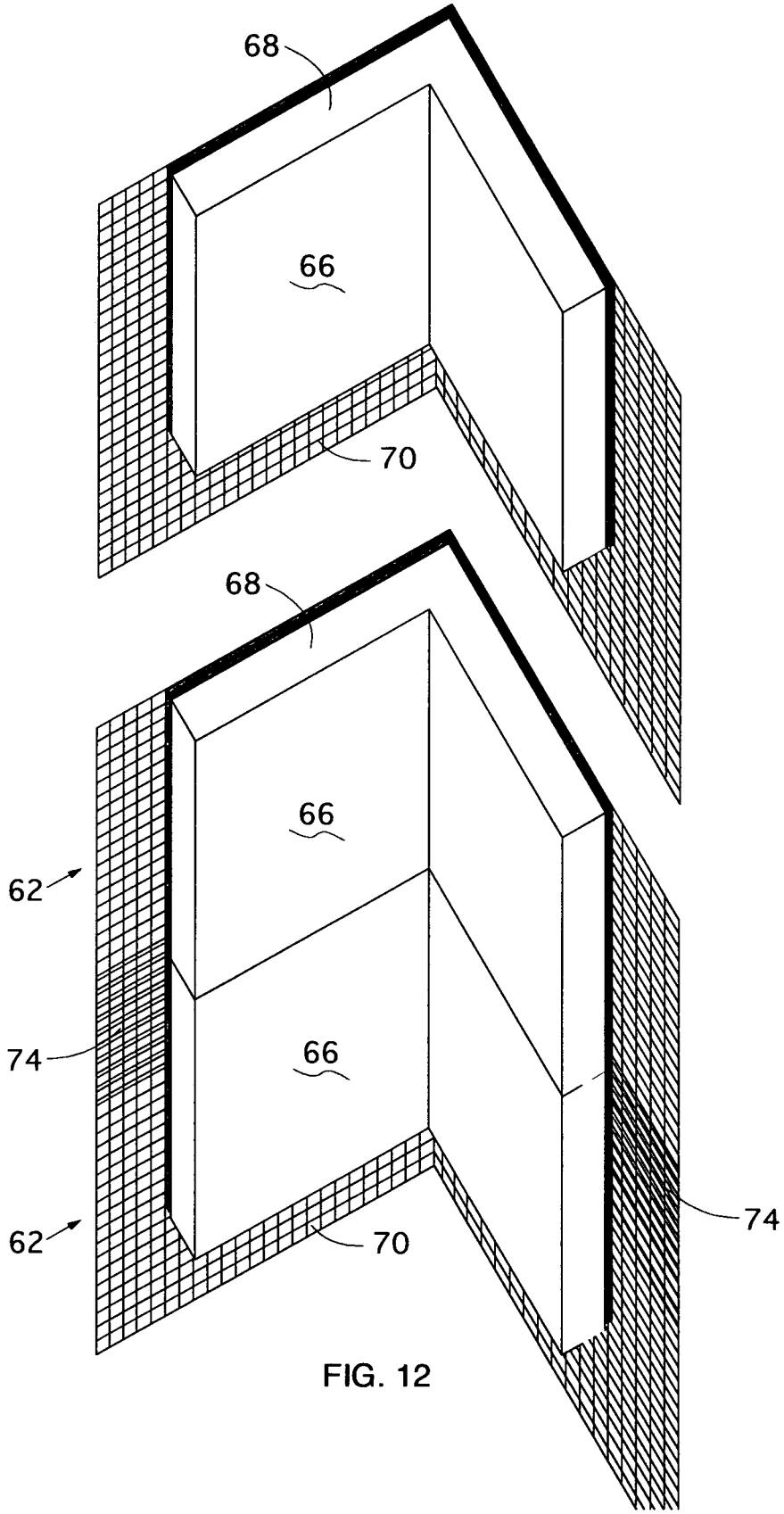
FIG. 12 is a perspective view from above showing the inner side of three corner pieces according to the invention, the lower two being mounted in accordance with the invention and the upper one being lowered into position.

It is also possible to employ a stanchion (not shown) secured to the slab 10 with or without an anchor plate 12 and formed with vertical grooves for receiving the ends of the logs 14, as disclosed for example in FIG. 12 of applicant's '089 patent mentioned above. In that case, little space—only cracks due to irregularities in the logs—is left between the logs.

If similar stanchions are employed in the present invention, spacers may be placed between the end connectors to provide the separation between the logs required to accommodate the insulating and strengthening saddles. Alternatively, the saddles themselves may support the logs and provide the required separation between them.

In FIG. 1, a wind blowing from the left against the wall 22 will tend to tilt the stack of end connectors 14 to the right. (It will also tend to tilt to the right the corresponding stacks of end connectors, not shown, at the far ends of the walls 18 and 22 and at the corner of the room opposite the pictured corner.) The upper left corner of the wall 18 will tend to move closer to the lower right corner of the wall (not shown), and the upper right corner (not shown) of the wall 18 will tend to move farther away from the lower left corner. The same applies to the wall, not shown, opposite the wall 18. The converse is also true: a wind blowing against the wall 18 or the wall opposite the wall 18 will tend to distort the wall 22 and the wall opposite the wall 22.

To counter this tendency, it is recommended in conventional practice to add crisscross bracing (X-bracing) to each of the walls, running from upper left to lower right and from lower left to upper right of each wall.

In the case of building superstructures constructed in accordance with the present invention, X-bracing is not needed. This results in a saving of materials, labor and construction time, and hence of cost. At the same time, it produces a continuous structural ensemble resistant to parallel horizontal forces.

Figure 2:
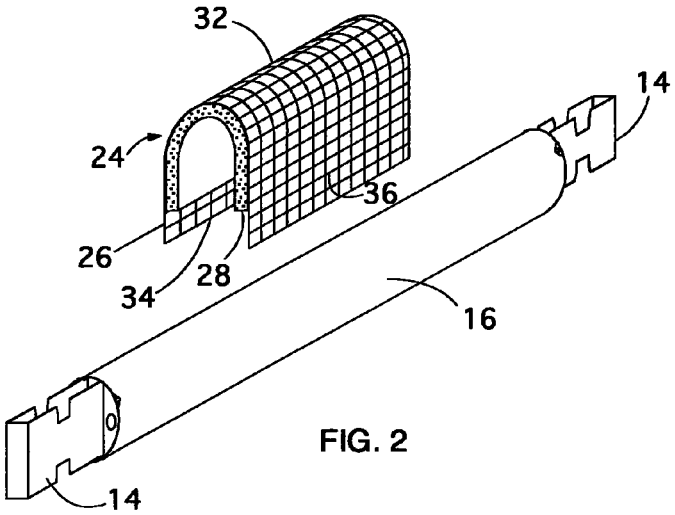
FIG. 2 is a perspective view from above showing an insulated saddle according to the invention being lowered onto a metalog.
Figure 5:
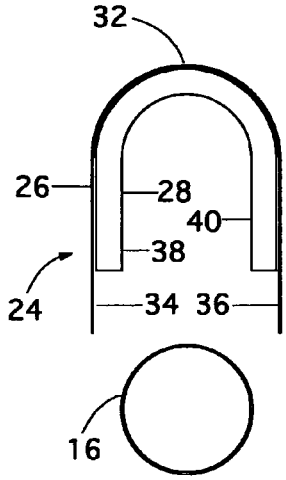
FIGS. 5-7 are schematic representations of the steps shown in FIGS. 2-4 respectively, shown end-on to illustrate the steps more clearly.

FIGS. 2 and 5 show saddles 24 about to be lowered onto a log 16. Each saddle 24 comprises a mesh 26 and insulation 28, which can be thermal and/or acoustical. The mesh 26 is U-shaped in cross section so that it has a concave surface 30. The insulation 28 is adhered to a section of the concave surface, preferably along or near the centerline 32 of the saddle 24 where the two legs 34 and 36 of the mesh 26 meet. Descending portions 38 and 40 of the insulation 28 are not adhered to the mesh 26 and are therefore free to wrap partway or all the way around the log 16. The insulation 28 may be attached to continuous paper or plastic membranes such as the membrane 41 (FIG. 17) on the outside and by means of such membranes to an organic or synthetic mesh 26 to ultimately allow the spraying of the resulting wall with some type of cement cladding.

Figure 3:
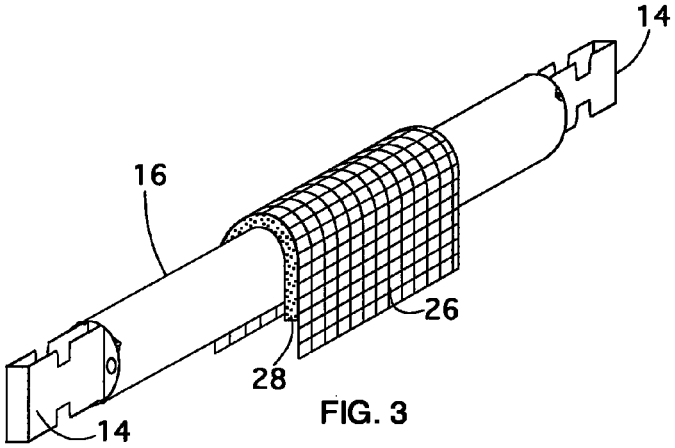
FIG. 3 is a perspective view from above showing the insulated saddle mounted on the log with the insulation hanging down on either side of the log.
Figure 6:
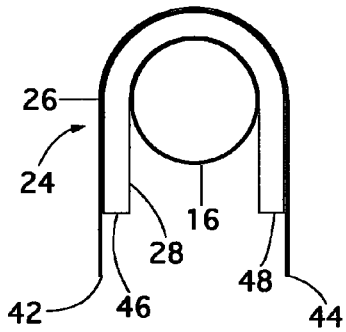

FIGS. 3 and 6 show the saddle 24 mounted on the log 16. The lower edges 42 and 44 of the mesh 26 and the lower edges 46 and 48 of the insulation 28 hang down below the log 16.

Figure 4:
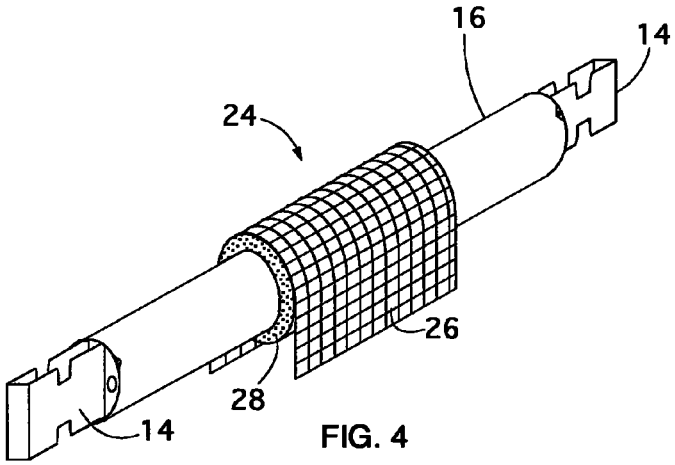
FIG. 4 is a perspective view from above showing that the portions of the insulation hanging down in FIG. 3 are curved around the log and joined together.
Figure 7:
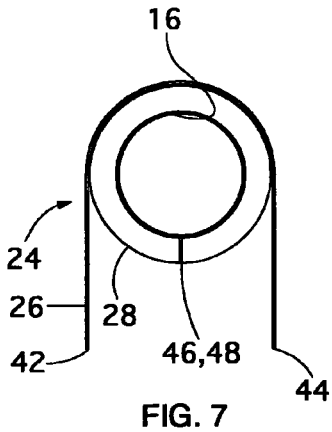

FIGS. 4 and 7 show the insulation 28 wrapped around the log 16 so that the edges 46 and 48 abut each other. There are several ways of accomplishing this. If the saddle 24 is mounted on the log 16 with the insulation 28 initially hanging down as in FIGS. 3 and 6, a simple tool such as a straight rod can be inserted through openings in the mesh 26 from either side to push the insulation around the log 16. In this case, an adhesive can be applied in advance to either the log 16 or the insulation 28 so that when the two are brought into contact by use of the tool, they adhere to each other; or staples or other fastening means can be employed at the end of a tool inserted through openings in the mesh 26 to secure the ends 46 and 48 to each other.

Another way of accomplishing this is to mount the saddles on the log and wrap the insulation around the log before installing the log in a wall or roof. In this case, the mesh 26 can (but need not) be replaced by a solid structure.

Figures 8, 9, 10:
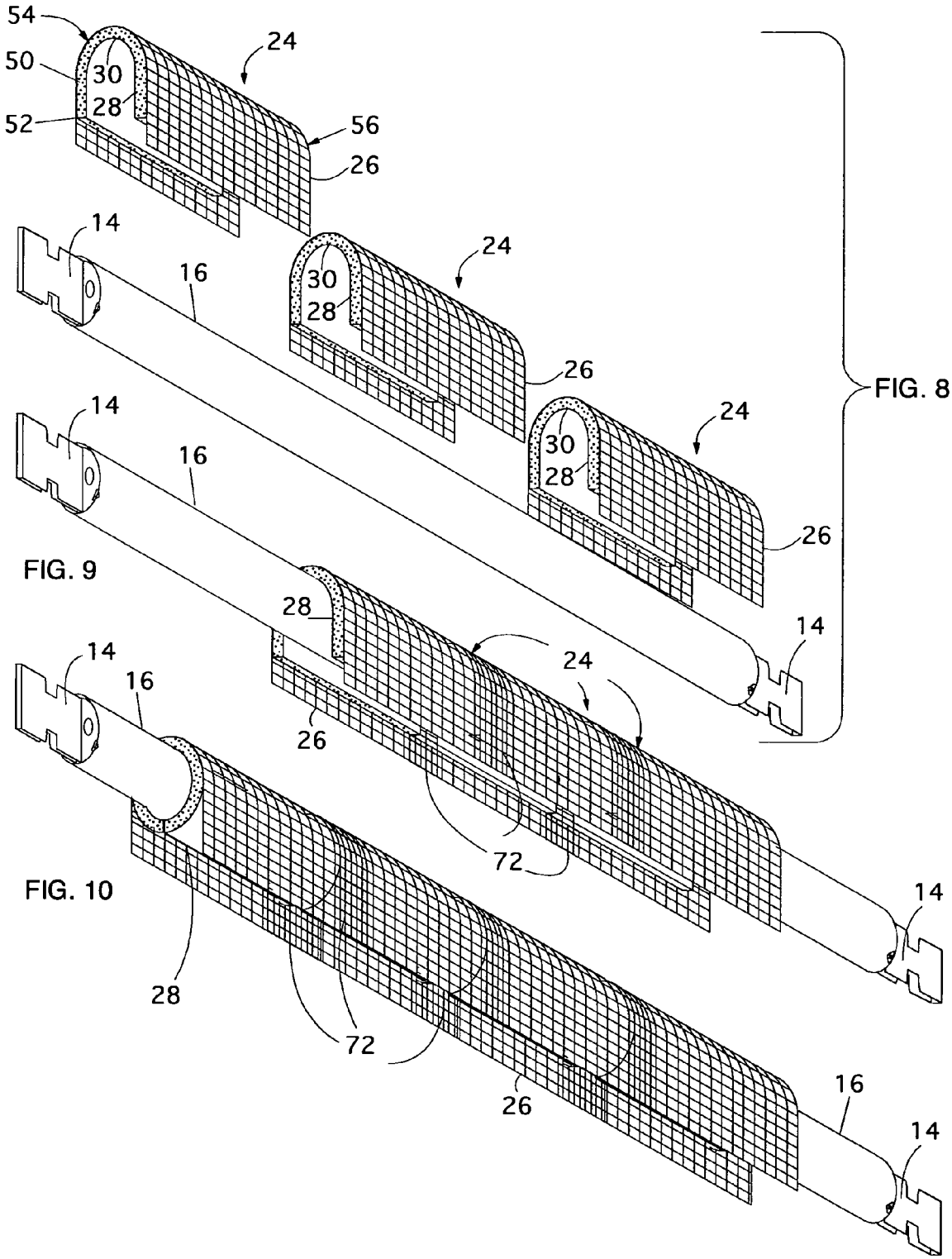
FIG. 8 is a perspective view similar to FIG. 2 but showing from below three insulated saddles according to the invention being lowered onto a metalog.
FIG. 9 is a perspective view similar to FIG. 3 but showing from below three insulated saddles according to the invention mounted on the metalog in overlapping relation with the insulation hanging down on either side of the log.
FIG. 10 is a view similar to FIG. 4 but showing from below three insulated saddles according to the invention mounted on the log in overlapping relation with the portions of the insulation hanging down in FIG. 9 curved around the log and joined together.

FIGS. 8-10 are similar to FIGS. 2-4 but show several saddles 24 being mounted on a log 16. The log 16 and each saddle 24 including its associated insulation 28 extend in an axial direction. In that direction, the log 16 is longer than the mesh 26 and the mesh 26 is longer than, its associated insulation 28. In accordance with the invention, an end 50 of the insulation 28 is aligned with an end 52 of its associated mesh 26 to form a strengthening and insulating unit having a flush end 54 wherein the mesh 26 and insulation 28 are in flush relation. Since the mesh 26 is longer in the axial direction than the associated insulation 28, the end opposite the flush end 54 is an overhang end 56 wherein the mesh 26 overhangs the insulation 28.

A plurality of such units are formed and mounted on the log 16 with the flush end of one unit inserted into the overhang end of an adjacent unit. (Equivalently, the overhang end of one unit envelops the flush end of an adjacent unit.)

Figure 13:
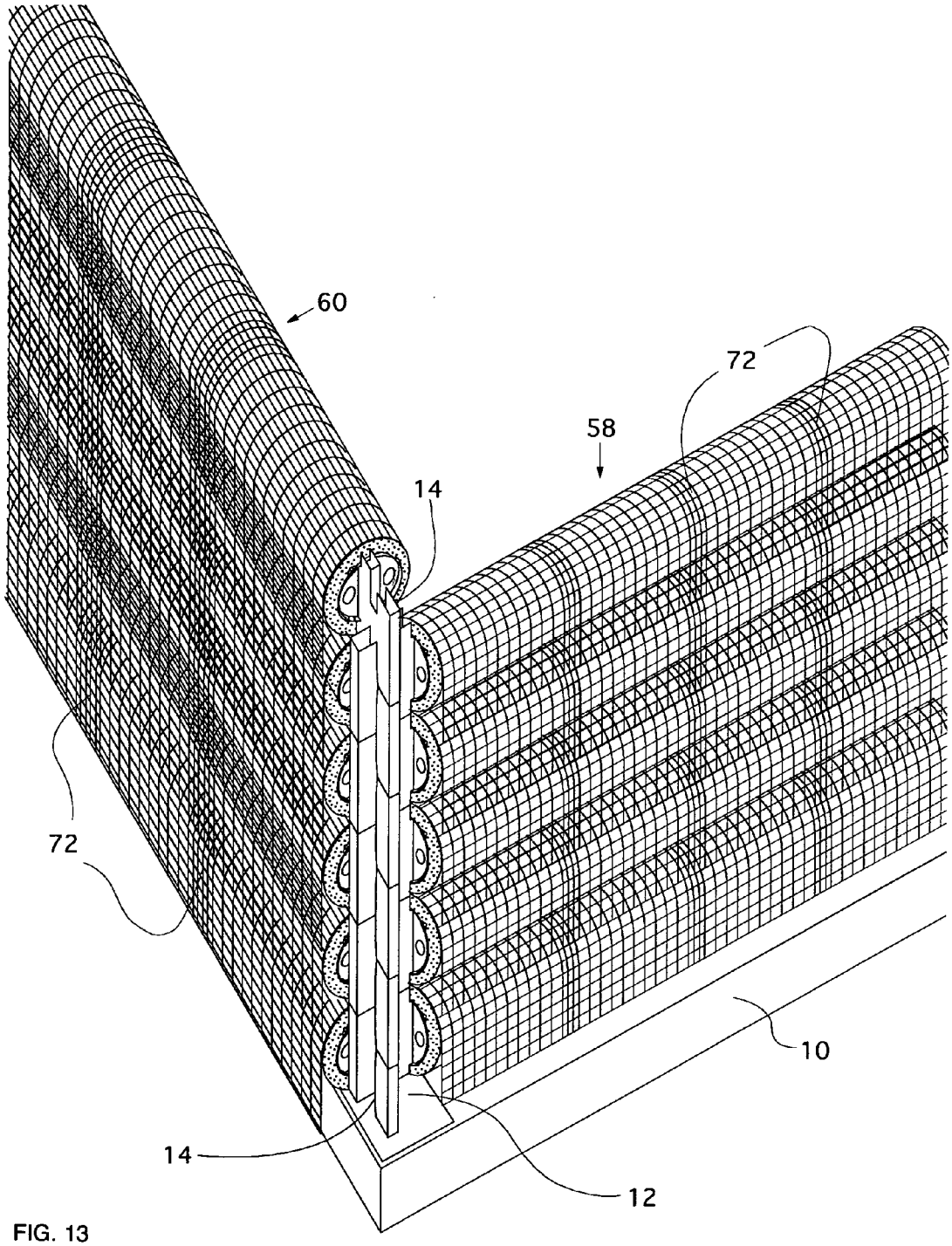
FIG. 13 is a fragmentary perspective view from above corresponding to FIG. 1 but showing a corner of a structure made of hollow metal logs insulated in accordance with the invention, wherein end connectors fit within the logs and are stacked one on top of another and the logs are supported by the end connectors in spaced-apart relation to form two walls that intersect at a right angle.
Figure 14:
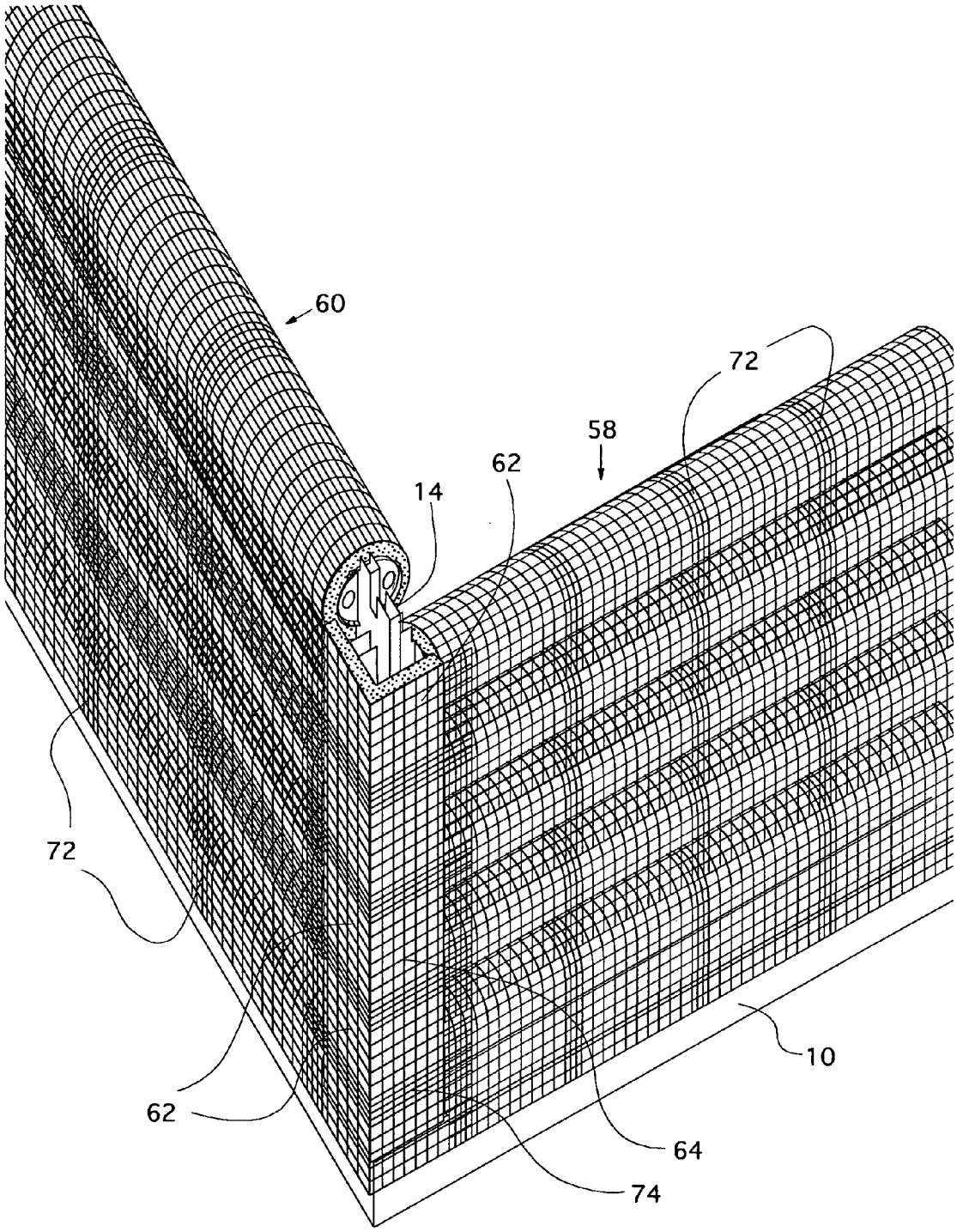
FIG. 14 is a view corresponding to FIG. 13 and showing the placement of insulated corner pieces in accordance with the invention.

As FIGS. 13 and 14 show, structure according to the invention normally includes, in addition to the first plurality or set of tubular structural members (e.g., metalogs), a second plurality or set of similar tubular structural members, arranged in parallel, planar, spaced-apart relation. The two sets form respective first and second walls 58, 60. Both sets are provided with saddle-shaped structural members formed with strengthening portions respectively having concave surfaces fitting partly around the tubular members and leaving clearance spaces, as described above. And in both sets, thermal and/or acoustic insulation is interposed in the clearance spaces between the respective strengthening portions and tubular members. Moreover, end connectors alternately connected to the tubular members of said first and second pluralities of tubular members in stacked relation to form a corner at which the first and second pluralities of tubular members meet at an angle. In a wall, the dihedral angle at which the planes of sections 58 and 60 meet is usually a right angle; in a roof, the angle is usually obtuse.

As FIG. 13 shows, the structure described above leaves the end connectors 14 exposed and without insulation. Accordingly, as FIG. 14 shows, the invention also includes insulated corner members 62 mounted adjacent to the end connectors and the first and second pluralities of tubular members to insulate the corner.

Figure 11:
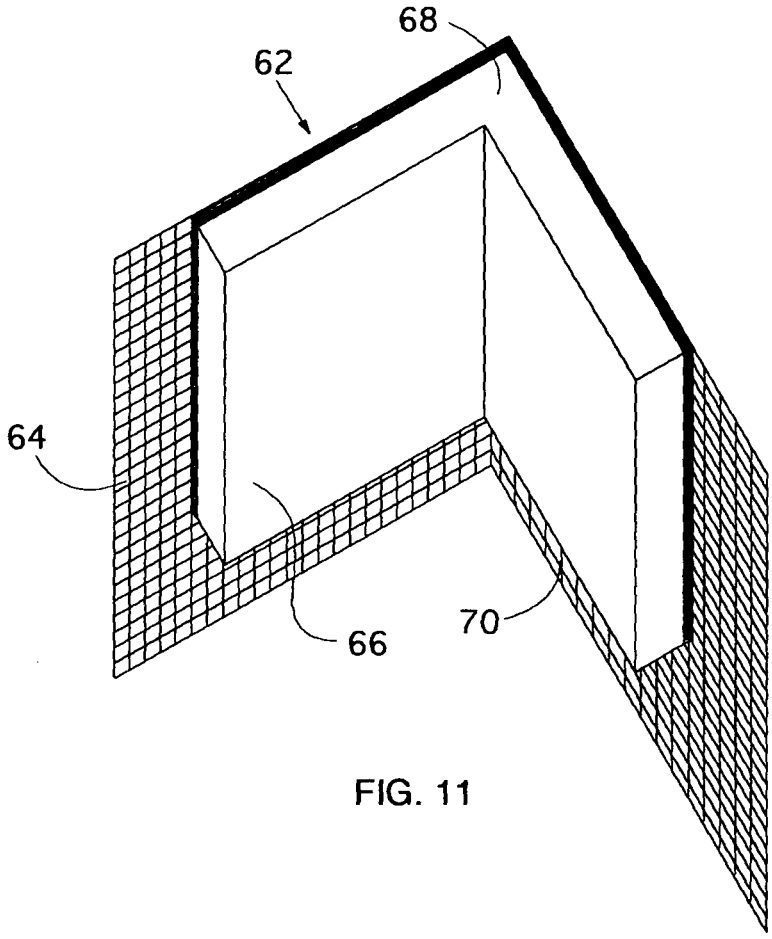
FIG. 11 is a perspective view from above showing the inner side of an insulated corner piece according to the invention for insulating the corner of a building constructed in accordance with the invention.

FIG. 11 shows the structure of a preferred embodiment of a corner member 62. It comprises a mesh 64 and insulation 66 adhered to the mesh 64. They are assembled in a manner similar to the assembly of the mesh 26 and insulation 28 to form a flush end 68 and an overhang end 70.

As FIG. 12 shows, a plurality of such units (corner members 62) are formed and stacked in overlapping relation with the flush end 68 of one unit inserted under the overhang end 70 of an adjacent unit. (Equivalently, the overhang end 70 of one unit covers the flush end 68 of an adjacent unit.)

FIGS. 9, 10, 13 and 14 clearly show the overlapping portions 72 of the meshes 26, and FIGS. 12 and 14 clearly show the overlapping portions 74 of the meshes 64.

Figure 17:
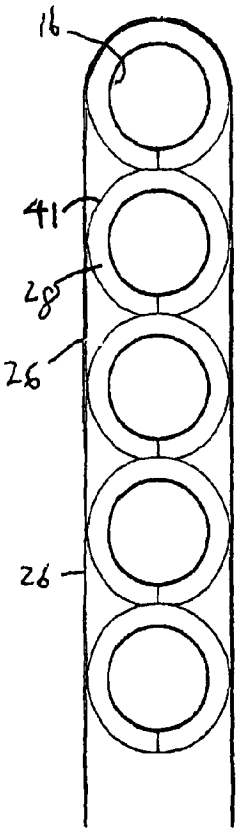
FIGS. 15-17 are schematic end-on views respectively showing three alternative structures of the saddles and their associated insulation in accordance with the invention.
Figure 16:
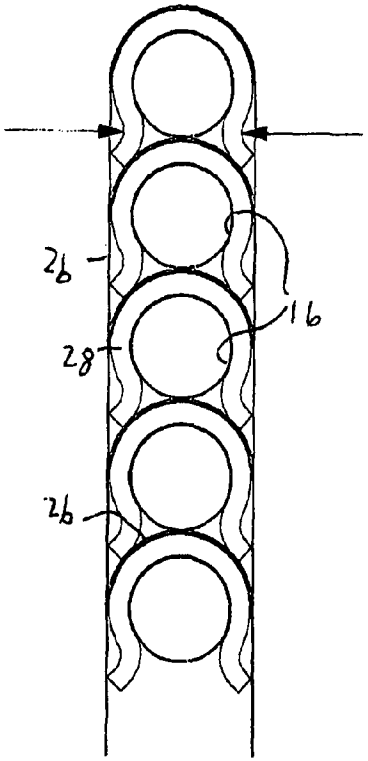
Figure 15:
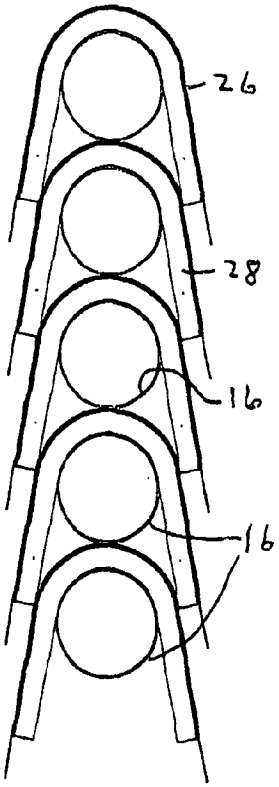

FIGS. 15-17 show different configurations of saddle-shaped structural members according to the invention. In each of those figures, the saddle-shaped structural members have a strengthening portion such as a mesh 26 formed with a concave surface and thermal and/or acoustical insulation 28. In each case also, the insulation 28 is adhered to the strengthening portion 26 near the concave surface and fits partly around a tubular structural member such as a metalog 16 adapted to form part of a wall or roof of a building. In FIG. 15, the meshes 26 and insulation 28 flare out towards the bottom. In FIG. 16, the insulation is pushed in to surround a greater portion of the log 16, as indicated by the arrows, and the meshes are substantially vertical, though they may flare slightly towards the bottom or have a small step to allow one mesh to overlap an adjacent mesh below. In FIG. 17, the insulation 28 is pushed all the way in to encircle the logs 16, and the meshes 26 are configured as in FIG. 16.

In each of FIGS. 15-17, the insulation 28 in one tier overlaps or is in close proximity to the insulation in the tier above and/or below to minimize the flow of heat and enhance the R-value of the wall or roof.

If solid structures are employed in place of the meshes 26 and/or 64, they will shed rain. Caulking can be used as needed. Or a finish such as stucco can be applied to the meshes with the same rain-shedding effect.

As the applicant's co-pending applications identified above explain, end connectors of different heights can be used. To increase the insulation between logs, taller end connectors are required. Or, if the ends of the logs are retained in grooves in vertical stanchions, then larger spacers between the logs can be used to increase the vertical separation between the logs and provide additional space between the logs for insulation. Also, the thickness of the insulation in a direction from the inside to the outside of the structure can be varied in accordance with the required R-value. In particular, that dimension can be increased in the roof as compared to the walls of a building, to counter the tendency of heated air to rise and escape through the roof. The radius of curvature of the concave surfaces 30 is adjusted to adapt the clearance space to the thickness of the insulation. Thus, the wraps may vary in thickness and type of material in order to take into account local availabilities and insulation requirements. Accordingly, the logs may be separated more or less from one another, by attaching them to connectors of different sizes.

It is preferred in accordance with the invention to add saddles 24 to all of the exterior walls and the roof of the edifice, but they can for economy be omitted from interior walls.

The meshes on the lower course can abut or overlap the foundation slab 10, as FIG. 13 shows.

The savings in time and materials made possible by the omission of X-bracing and sheathing or other finishing could not have been predicted but are measurable and substantial. The illustrated embodiments of the invention are the ones preferred, but others may be envisioned.

Thus there is provided in accordance with the invention a novel and highly effective structure and method accomplishing the stated objects and others. The insulating sheathing panels that might otherwise be used have considerable volumes that are expensive to transport to the construction site. They also require a large complement of screws and glue, which are expensive and time-consuming to install. Finally, they are usually made of polystyrene, which is fairly expensive. Wrapping each of the logs with even one inch of rock wool greatly increases the thermal insulation capacity of the air chambers, even though the residual space between the logs must be increased to accommodate the insulation. The interstices between the logs are hermetically closed by the insulation.

Many modifications within the scope of the invention will readily occur to those skilled in the art upon consideration of this disclosure. The invention encompasses all such structures and methods as fall within the scope of the appended claims.

The invention claimed is:

1. A structure comprising a plurality of tubular structural members arranged in parallel, planar, spaced-apart relation, a plurality of saddle-shaped structural members respectively having strengthening portions formed with concave surfaces fitting partly around the tubular members and leaving clearance spaces, and thermal insulation interposed in the clearance spaces between the strengthening portions and the tubular members, said insulation being adhered to the saddle-shaped structural member near the concave surfaces and having at least one descending portion that is not adhered and therefore free to wrap partway or all the way around said tubular members, said structure forming part of a wall or roof of a building superstructure, wherein the strengthening portions are formed with openings whereby direct contact and manipulation of the insulation can be made through the openings in the strengthening portion from a position exterior to the wall or roof.

2. A structure according to claim 1 wherein the tubular members are made of a metal, cementitious or synthetic material and the strengthening portions are made of a material selected from the group consisting of a metal, a synthetic material, a cementitious material, a natural fiber, and combinations of two or more thereof.

3. A structure according to claim 1 wherein the strengthening portions are formed as respective meshes providing said openings.

4. A structure according to claim 1 further comprising a second plurality of tubular structural members arranged in parallel, planar, spaced-apart relation, a second plurality of saddle-shaped structural members formed with strengthening portions respectively having concave surfaces fitting partly around the second plurality of tubular members and leaving second clearance spaces, second thermal insulation interposed in the second clearance spaces between the second plurality of strengthening portions and the second plurality of tubular members, and a plurality of end connectors alternately connected to the tubular members of said first and second pluralities of tubular members in stacked relation to form a corner at which said first and second pluralities of tubular members meet at an angle.

5. A structure according to claim 4 wherein said angle is a right angle.

6. A structure according to claim 4 comprising at least one insulated corner member mounted adjacent to the end connectors and said first and second pluralities of tubular members to insulate the corner.

7. A structure according to claim 1 wherein the strengthening portions are U-shaped, with legs of substantially equal length.

8. A saddle-shaped structural member according to claim 1 wherein the thermal insulation serves also as acoustical insulation.

9. A method comprising the steps of selecting a tubular structural member as a part of a wall or roof of a building superstructure, selecting a saddle-shaped structural member formed with a strengthening portion having a concave surface sized to fit partly around the tubular member leaving a clearance space, selecting thermal insulation of a thickness proportional to the clearance space, adhering the insulation to the saddle-shaped member near the concave surface but not at least one location spaced apart from the concave surface, curving said insulation at said spaced-apart location at least partway around said tubular member, forming an assembly wherein the insulation is sandwiched between the tubular member and the strengthening portion, forming openings in the strengthening portion, and directly contacting and manipulating the insulation through said openings from a position exterior to the wall or roof.

10. A method according to claim 9 comprising the steps of forming a preliminary assembly comprising the insulation and the strengthening portion and then mounting the preliminary assembly on the tubular member.

11. A method according to claim 10 comprising the step of forming the preliminary assembly at an actual building construction location.

12. A method according to claim 10 comprising the steps of forming the preliminary assembly at a workshop removed from an actual building construction location and transporting or carrying the preliminary assembly to the construction location.

13. A method according to claim 9 comprising the steps of forming an alternative preliminary assembly comprising the insulation and the tubular member and then mounting the strengthening portion on the alternative preliminary assembly.

14. A method according to claim 13 comprising the step of forming the alternative preliminary assembly at a building construction location.

15. A method according to claim 13 comprising the steps of forming the alternative preliminary assembly at a workshop removed from an actual building construction location and transporting or carrying the alternative preliminary assembly to the construction location.

16. A method according to claim 9 wherein the tubular member, strengthening portion and insulation extend in an axial direction and, in that direction, the tubular member is longer than the strengthening portion and the strengthening portion is longer than the insulation, and comprising the steps of aligning an end of the insulation with an end of the strengthening portion to form a first strengthening and insulating unit having a flush end wherein the strengthening portion and insulation are in flush relation and an overhang end wherein the strengthening portion overhangs the insulation, forming a second strengthening and insulating unit of the same configuration as the first strengthening and insulating unit, and mounting said first and second units on the tubular member with the flush end of one unit inserted into the overhang end of the other unit for structural rigidity.

* * * * *